United States Patent [19]

Capek et al.

[11] Patent Number: 5,047,684

[45] Date of Patent: Sep. 10, 1991

[54] MASK SUPPORT STRUCTURE FOR TENSION MASK COLOR CATHODE RAY TUBES

[75] Inventors: Raymond G. Capek, Elmhurst; Lawrence W. Dougherty, Sleepy Hollow; Andrew S. Parry, Wildwood, all of Ill.

[73] Assignee: Zenith Electronics Corporation, Glenview, Ill.

[21] Appl. No.: 566,721

[22] Filed: Aug. 13, 1990

[51] Int. Cl.[5] ..... H01J 29/07

[52] U.S. Cl. ..... 313/407; 313/402; 313/408

[58] Field of Search ..... 313/402, 407, 408

[56] References Cited

U.S. PATENT DOCUMENTS

| | | | |
|---|---|---|---|
| 4,737,681 | 4/1988 | Dietch et al. | 313/407 |
| 4,745,330 | 5/1988 | Capek et al. | 313/407 |
| 4,790,786 | 12/1988 | Strauss | 445/68 |
| 4,828,095 | 5/1989 | Kilwin | 192/150 |
| 4,828,523 | 5/1989 | Fendley et al. | 445/30 |
| 4,891,546 | 1/1990 | Dougherty et al. | 313/407 |
| 4,908,995 | 3/1990 | Dougherty et al. | 51/281 R |
| 4,925,421 | 5/1990 | Van den Brock | 313/408 |

*Primary Examiner*—Donald J. Yusko
*Assistant Examiner*—Diab Hamadi

[57] ABSTRACT

A tension mask color cathode ray tube includes a glass faceplate having on its inner surface a centrally disposed, rectangular screening area. A shadow mask support structure located on opposed sides of the screening area has a mask-receiving member embedded therein.

15 Claims, 2 Drawing Sheets

MASK SUPPORT STRUCTURE FOR TENSION MASK COLOR CATHODE RAY TUBES

CROSS REFERENCE TO RELATED APPLICATIONS

This application is related to but in no way dependent upon copending applications Ser. No. 454,223 filed Dec. 21, 1989; Ser. No. 458,129 filed Dec. 28, 1989; Ser. No. 427,149 filed Oct. 24, 1989; and Ser. No. 269,822 Pat. No. 4,891,546, issued Jan. 2, 1990) of common ownership herewith.

BACKGROUND OF THE INVENTION

1. Field of the Invention

This invention relates to color cathode ray picture tubes, and is addressed specifically to the manufacture of tubes having shadow masks of the tension foil type in association with a substantially flat faceplate. The invention is useful in the manufacture of color tubes of various types, including those used in home entertainment television receivers, and in mediumresolution and high-resolution tubes intended for color monitors.

The tension foil shadow mask is a part of the cathode ray tube front assembly, and is located in close adjacency to the faceplate. As used herein, the term "shadow mask" means an apertured metallic foil which may, by way of example, be about 0.001 inch thick, or less. The mask is supported in high tension a predetermined distance from the inner surface of the faceplate; this dimension is known as the "Q-height." As is well known in the art, the shadow mask acts as a color-selection electrode, or "parallax barrier," which ensures that each of the three beams generated by the electron gun located in the neck of the tube lands only on its assigned phosphor deposits.

2. Prior Art

U.S. Pat. Nos. 4,908,995; 4,828,523; 4,790,786; 4,745,330; 4,828,095; and 4,737,681, all of common ownership herewith.

OBJECTS OF THE INVENTION

It is a general object of the invention to provide means and process for use in the manufacture of tension mask color cathode ray tubes that simplify production and reduce production costs.

It is an object of the invention to provide a faceplate assembly having improved means for mounting a tensed foil shadow mask.

It is another object of the invention to provide an improved support structure and process for mounting a tensed foil shadow mask in association with a substantially flat faceplate.

It is a specific object of the invention to provide a shadow mask support structure that is mechanically rigid, easy to manufacture, and which uses a minimum amount of costly alloy.

BRIEF DESCRIPTION OF THE DRAWINGS

The features of the present invention which are believed to be novel are set forth with particularity in the appended claims. The invention, together with further objects and advantages thereof, may be best understood by reference to the following description taken in conjunction with the accompanying drawings (not to scale), in the several figures of which like reference numerals identify like elements, and in which:

DESCRIPTION OF THE PREFERRED EMBODIMENT

Figure 1:
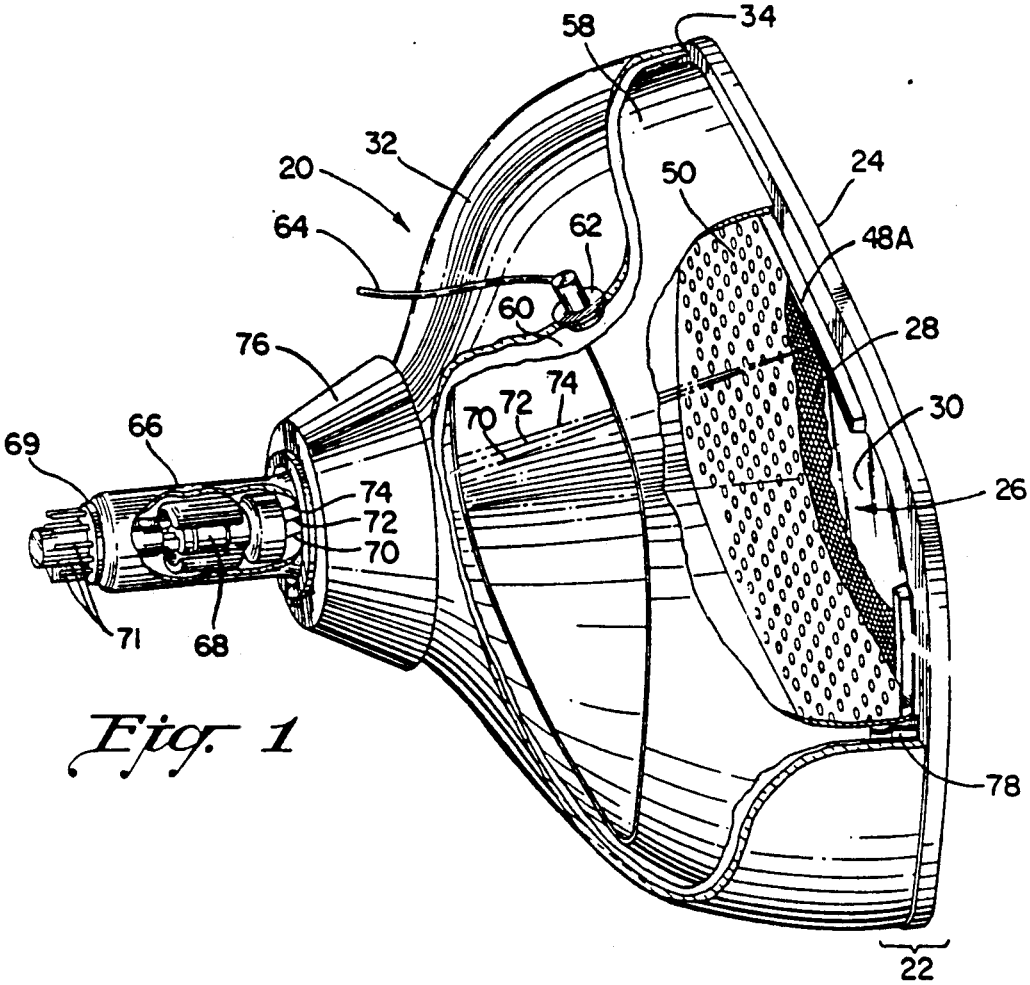
FIG. 1 is a side view in perspective of a tension mask color cathode ray tube having a prefabricated mask support structure subject to the means and process according to the invention, with cutaway sections that indicated the location and relationship of the major components of the tube.
Figure 2:
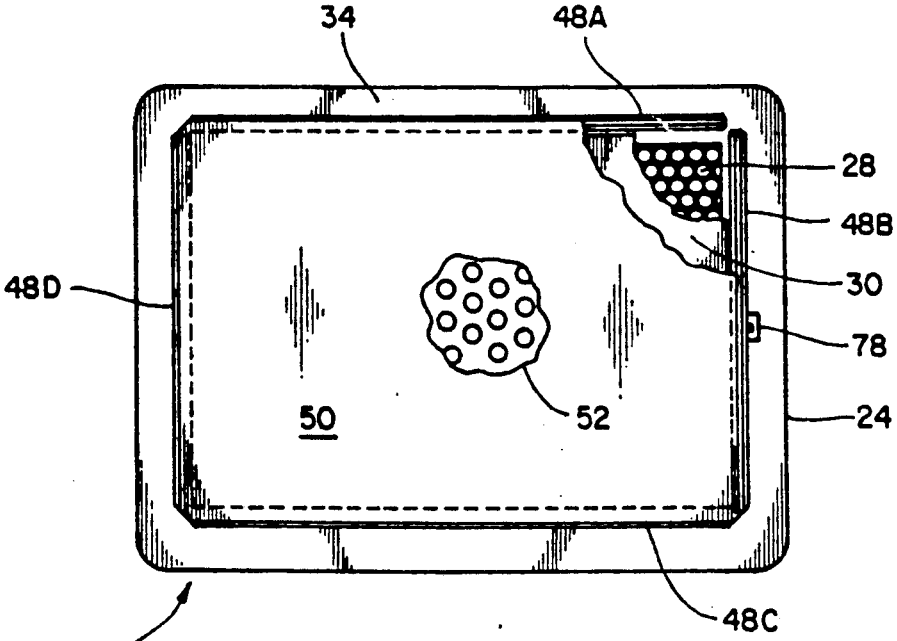
FIG. 2 is a plan view of the front assembly of a flat tension mask color cathode ray tube depicted in FIG. 1, with parts cut away to show the relationship of the faceplate with the mask support structure and shadow mask; insets show mask apertures and phosphor screen patterns greatly enlarged.

A color cathode ray tube having a tension mask support structure according to the invention is depicted in FIGS. 1 and 2. The tube and its component parts are identified in the figures, and described in the following paragraphs in this sequence: reference number, a reference name, and a brief description of structure, interconnections, relationship, functions, operation, and/or result, as appropriate.

20: tension mask color cathode ray tube

22: front assembly

24: glass faceplate

26: inner surface of faceplate

28: centrally located phosphor screen on inner surface 26 of faceplate 24; the round deposits of phosphor, shown as surrounded by the black matrix, are depicted greatly enlarged; the screen is also referred to as "the screening area"

30: film of aluminum

32: funnel

34: peripheral sealing area of faceplate 24, adapted to mate with the peripheral sealing area of the mouth of funnel 32

48: mask support structure according to the invention; the structure may be "unitary" in that it can be installed as a prefabricated unit in a foil tension mask cathode ray tube, or it may comprise four discrete supports 48A, 48B, 48C, and 48D located on opposed sides of the screen 28, as indicated by FIG. 2. The mask-receiving surface may be preground to provide a planar surface before installation of the structure

50: metal foil shadow mask; after being tensed, the mask is mounted on mask support structure 48 and secured thereto

52: shadow mask apertures, indicated as greatly enlarged in the inset for illustrative purposes; there is one aperture for every triad of phosphor deposits

58: magnetic shield, internal (a shield, not shown, may also be installed external to the tube envelope)

60: internal conductive coating on funnel

62: anode button

64: high-voltage conductor

66: neck of tube

68: in-line electron gun providing three discrete in-line electron beams 70, 72 and 74 for exciting respective red-light-emitting, green-light-emitting and blue-light-emitting phosphor deposits on screen 28

69: base of tube

71: metal pins for conducting operating voltages through the base of the tube 69 to the electron gun 68

76: yoke which provides for the traverse of beams 70, 72 and 74 across screen 28

78: contact spring which provides an electrical path between the funnel coating 60 and the mask support structure 48.

Figure 3:
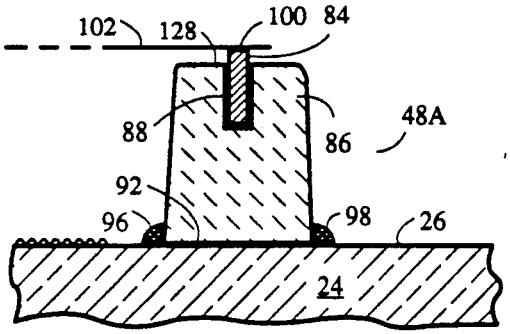
FIGS. 3–6 are cross-sectional detail views in elevation of preferred embodiments of shadow mask support structures according to the invention.

FIG. 3 depicts one section, section 48A, of a mask-support structure having a mask-receiving member 84 shown as embedded therein. The mask-support structure indicated in FIG. 2 is shown as being composed of four parts 48A, 48B, 48C and 48D located on opposed sides of the centrally disposed, rectangular screening area. The body 86 of mask-support structure 48A is indicated by way of example as being composed of a ceramic, and the mask-receiving member 84 of a metal, preferably a metal alloy. Mask-support structure 48A, which is shown as being substantially rectangular, has a recess 88 therein noted as being lengthwise. The mask-receiving member according to the invention is cemented in the recess.

Support structure 48A is indicated as being attached to the inner surface 26 of faceplate 24; attachment is by means of a devitrifying solder glass which is applied in paste form to the base 92 of structure 48A. The base 92 is placed in contact with the inner surface 26 of faceplate 24, and the assemblage is heated to a temperature of about 460 degrees C. The solder glass melts and devitrifies, and upon cooling, provides for permanent attachment of the structure to the faceplate. The thickness of the solder glass between the base 92 of structure 48A and the inner surface 26 of faceplate 24 is preferably about 0.005 inch. The excess solder glass appears in the form of fillets 96 and 98 which serve to reinforce the attachment of structure 48A to faceplate 24. The solder glass may comprise, by way of example, solder glass No. CV-685 manufactured by Owens-Illinois of Toledo, Ohio.

The mask-receiving member is cemented into the recess. Uncured cement, that is, cement in other than solid form, is inserted into recess 88, then a mask-receiving member adapted to fit the recess is inserted into the recess. The cement is then allowed to cure to permanently secure the mask-receiving member in the recess. The cement according to the invention comprises a devitrifying solder glass which is inserted into the recess in paste form. When heated to a temperature of about 450 degrees C., the solder glass melts and devitrifies, permanently securing the mask-receiving member into the recess. The solder glass may be the same as that specified in the foregoing for cementing the support structure to the faceplate, that is, solder glass No. CV-685. The thickness of the cement that encloses the mask-receiving member is of the order of 0.005 inch.

Mask receiving member 84 is indicated as being a strip of metal of rectangular cross-section having an edge 100 for receiving and securing a tensed foil shadow mask 102. The thickness of member 84 is in the range of 0.015 to 0.030 inch. Mask 102 is preferably secured to edge 100 by laser welding, a procedure fully described and claimed in referent U.S. Pat. No. 4,828,523, of common ownership herewith.

Figure 4:
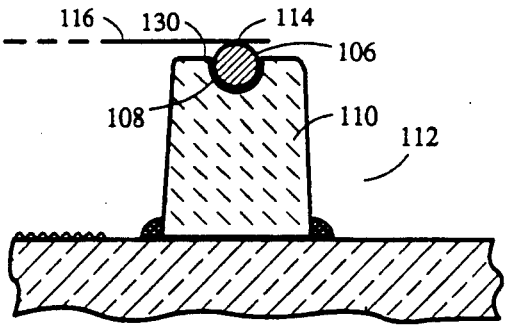
Figure 5:
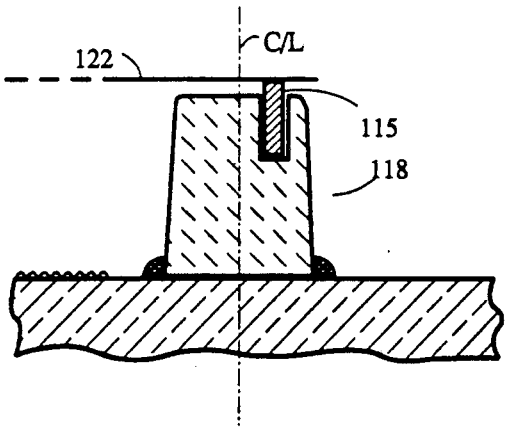
Figure 6:
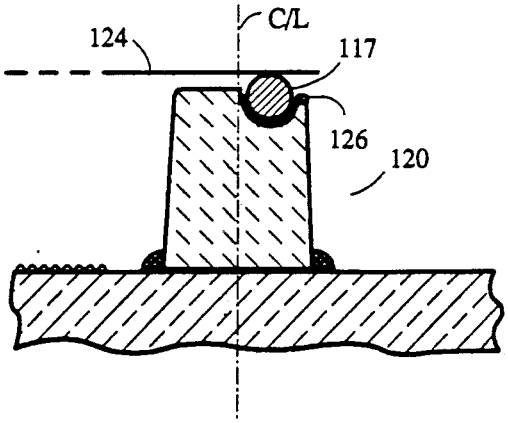

It is to be noted that the general conformation of the mask support structures and associated parts and means of attachment depicted in FIGS. 4–6 is identical to that shown by FIG. 3, except for the difference in the shape of the mask-receiving member and its interface with the body of the support structure. To simplify the following description of further embodiments of mask support structures according to the invention, only those differences will be cited in the following.

The mask-receiving member may also comprise a wire, as indicated by mask-receiving member 106 in FIG. 4. It will be noted that the recess 108 in the body 110 of mask support structure 112 is contoured to accept the circular configuration of member 106. The surface 114 that provides for receiving and securing shadow mask 116 is preferably ground to a flat about 0.030 inch wide; a production-tested procedure for grinding a metal mask receiving surface is set forth in referent U.S. Pat. No. 4,908,995, of common ownership herewith.

As shown in FIGS. 5 and 6, a mask-receiving member may be displaced outwardly from the centerline (C/L) of the structures, that is, away from the screening surface. Such displacement is indicated by the outward displacement of mask-support members 115 and 117 in respective mask-support structures 118 and 120. By displacing the mask-receiving members as indicated, the members are more resistant to the inward pull of the respective shadow masks 122 and 124, which are under a tension of about 30,000 psi. With regard to FIG. 6, an additional deposit of cement 126 provides for additional reinforcement of the structure and its attachment to the mask-receiving member 117.

The material of the mask receiving members—members 84, 106, 115 and 117—preferably comprises an alloy having a coefficient of thermal contraction compatible with the ceramic material of the bodies of the support structures. A suitable material is Alloy No. 27 manufactured by Carpenter Technology of Reading, Pa.. It has a CTC (coefficient of thermal contraction) of approximately 105 to $109\times10^{-7}$ in/in/degree C. over the range of the temperatures required for devitrification of the solder glass used to cement the tube components together. This range of temperature is from ambient to 450 degrees C. Alloys having equivalent characteristics supplied by other manufacturers may as well be used.

The ceramic component of the support structures disclosed herein is preferably a form of forsterite. A preferred composition comprises:

Talc ($MgO+SiO_2$), 62%
Magnesia (MgO), 28%
Ball Clay, 4%
Barium Carbonate, 6%
Total: 100%

The mask support structures are preferably made by extruding the ceramic in the form of "rails" having the desired contour. The recess in the structure, as typified by recess 88 in figure 3, can be formed during the extrusion process. After extrusion, the ceramic is in a "green" state, and must be fired to sinter and devitrify it, and impart maximum strength.

With regard to dimensions, and by way of example: mask-receiving member 84 in FIG. 3 projects above the top surface 128 of the body 86 of support structure 48A by about 0.015 inch, and the depth of recess 88 is about 0.050 inch. The diameter of circular mask-receiving member 106 depicted in FIG. 4 is about 0.060 inch, and it projects above the top surface 130 of support structure 112 about 0.015 inch. The "Q-height" of the structures—that is, the distance between the inner surface of the faceplate and the mask-receiving surface—is about 0.290 inch, and the width of the structure at the base about 0.220 inch.

The benefits provided by the mask-support structure according to the invention include simplification of the structure and reduced use of costly alloys. The mask-support members 84 and 106 which comprise, respectively, a metal strip and a wire, are easily formed by standard metal-working techniques. Minimum amounts of metal are used, providing not only cost savings, but also a reduction in weight. Further, the process of attaching a metal mask-receiving member to the ceramic is simplified, and the attachment is much stronger.

While a particular embodiment of the invention has been shown and described, it will be readily apparent to those skilled in the art that changes and modifications may be made in the inventive apparatus and process without departing from the invention in its broader aspects, and therefore, the aim of the appended claims is to cover all such changes and modifications as fall within the true spirit and scope of the invention.

We claim:

1. A tension mask color cathode ray tube including a glass faceplate having on its inner surface a centrally disposed, rectangular screening area, and on opposed sides thereof, a shadow mask support structure having mask-receiving member embedded therein, the body of said mask support structure wrapping substantially around said mask-receiving member such that said mask-receiving member protrudes from said mask support structure in a direction which is not parallel to the plane of force applied by a tension mask attached to said mask-receiving means, whereby the bond of said mask-receiving member and said mask support structures does not lie in such plane of force applied by a mask, the body strength of said mask support structure, rather than the shear strength of said bond, providing the primary resistance to such mask-applied force.

2. The mask support structure defined by claim 1 wherein said mask support structure has a recess therein, and wherein said mask-receiving member is cemented in said recess and extends to a depth significantly greater than the distance said mask receiving member protrudes from said recess.

3. The mask support structure defined by claim 1 wherein said mask-receiving member is a metal alloy, and said mask support structure is a ceramic, the cross-section of said mask-receiving member being small relative to the cross-section of said support structure.

4. The tension mask color cathode ray tube of claim 3 wherein said metal alloy is cemented into a recess in said ceramic.

5. The tension mask color cathode ray tube of claim 4 wherein the cement is a devitrifying solder glass.

6. The tension mask color cathode ray tube of claim 2 wherein said mask-receiving member is a metal wire.

7. The tension mask color cathode ray tube of claim 2 wherein said mask-receiving member is a rectangular strip of metal having an edge oriented for receiving and securing a shadow mask.

8. The tension mask color cathode ray tube of claim 3 wherein said metal alloy is an alloy having a coefficient of thermal contraction compatible with the coefficient of thermal contraction of said ceramic.

9. The tension mask color cathode ray tube of claim 1 wherein said mask-receiving member is displaced outwardly from the center-line of said mask support structure.

10. The tension mask color cathode ray tube of claim 4 wherein said metal alloy is Carpenter Alloy No. 27.

11. A tension mask color cathode ray tube including a glass faceplate having on its inner surface a centrally disposed, rectangular screening area, and on opposed sides thereof, a ceramic shadow mask support structure having a metal mask-receiving member of rectangular cross-section oriented orthogonally to said faceplate and cemented deeply edge first in a recess in said mask support structure, an opposing edge protruding from said recess being adapted to receive and retain a shadow mask in tension.

12. A tension mask color cathode ray tube including a glass faceplate having on its inner surface a centrally disposed, rectangular screening area, and on opposed sides thereof, a ceramic shadow mask support structure having a metallic alloy mask-receiving member of rectangular cross-section cemented in a recess in said mask support structure with devitrifying solder glass, said recess opening in a direction away from said faceplate.

13. A tension mask color cathode ray tube including a glass faceplate having on its inner surface a centrally disposed, rectangular screening area, and on opposed sides thereof, a ceramic shadow mask support structure having a metallic alloy mask-receiving member in the form of a wire of circular cross-section cemented in a recess in said mask support structure with devitrifying solder glass.

14. A tension mask color cathode ray tube including a glass faceplate having on its inner surface a centrally disposed, rectangular screening area, and on opposed sides thereof, a ceramic shadow mask support structure having a metallic alloy mask-receiving member cemented in a recess in said mask support structure with devitrifying solder glass, said mask-receiving member being in the form of a strip of metal of rectangular cross-section having an edge inserted deeply in said recess, an opposed edge protruding from said recess being adapted to receive and support a shadow mask in tension, the width of said protruding opposed edge being predetermined to accommodate attachment of a mask thereto by laser welding.

15. A tension mask color cathode ray tube including a glass faceplate having on its inner surface a centrally disposed, rectangular screening area, and on opposed sides thereof, a ceramic shadow mask support structure having a metallic mask-receiving member displaced outwardly from a center-line of said mask support structure, and cemented in a recess in said structure with devitrifying solder glass.

* * * * *